US006780144B2

(12) United States Patent
Stevens

(10) Patent No.: US 6,780,144 B2
(45) Date of Patent: Aug. 24, 2004

(54) SEGMENTED WEIGHT AND EXERCISER

(76) Inventor: Kenneth V. Stevens, 728 Carroll St., Brooklyn, NY (US) 11215

( * ) Notice: Subject to any disclaimer, the term of this patent is extended or adjusted under 35 U.S.C. 154(b) by 146 days.

(21) Appl. No.: 09/947,322

(22) Filed: Sep. 6, 2001

(65) Prior Publication Data

US 2003/0050153 A1 Mar. 13, 2003

(51) Int. Cl.[7] ..... A63B 21/002
(52) U.S. Cl. ..... 482/91; 482/50; 482/120
(58) Field of Search ..... 482/44, 46, 50, 482/92, 93, 99, 91, 110, 114, 115, 116, 120, 908

(56) References Cited

U.S. PATENT DOCUMENTS

| | | | | |
|---|---|---|---|---|
| 590,050 A | | 9/1897 | Webb | |
| 610,416 A | | 9/1898 | Sandow | |
| 702,356 A | | 6/1902 | Calvert | |
| 983,372 A | | 2/1911 | Johnson | |
| 2,821,394 A | | 1/1958 | Barbeau | 272/83 |
| 3,129,940 A | | 4/1964 | Lauro | 272/79 |
| 3,752,475 A | | 8/1973 | Ott | 272/83 |
| 3,982,755 A | | 9/1976 | Sarich | 272/117 |
| 4,114,874 A | | 9/1978 | Mattila | 272/71 |
| 4,114,875 A | | 9/1978 | Deluty | 272/133 |
| 4,134,584 A | | 1/1979 | Rosenbusch | 272/117 |
| 4,290,225 A | * | 9/1981 | MacCarthy | 446/250 |
| 4,442,625 A | * | 4/1984 | MacCarthy | 446/250 |
| 4,482,151 A | | 11/1984 | Zwilling | 272/123 |
| 4,515,364 A | | 5/1985 | Rotella | 272/143 |
| 5,004,229 A | | 4/1991 | Lind | 272/127 |
| 5,037,087 A | | 8/1991 | Roth | 272/117 |
| 5,060,933 A | | 10/1991 | Cedro | 272/67 |
| 5,176,599 A | | 1/1993 | Beliakov | 482/91 |
| 5,203,753 A | | 4/1993 | Rothhammer | 482/111 |
| 5,242,350 A | | 9/1993 | Chang | 482/108 |
| 5,304,104 A | | 4/1994 | Chi | 482/1 |
| 5,360,382 A | | 11/1994 | Chi | 482/1 |
| 5,380,261 A | | 1/1995 | Mora | 482/46 |
| 5,391,133 A | | 2/1995 | Ruffa | 482/92 |
| 5,429,571 A | | 7/1995 | Smith et al. | 482/115 |
| 5,486,149 A | | 1/1996 | Smith et al. | 482/120 |
| 5,499,961 A | | 3/1996 | Mattox | 482/132 |
| 5,512,028 A | | 4/1996 | Sparks | 482/92 |
| 5,618,249 A | | 4/1997 | Marshall | 482/127 |
| 5,716,305 A | | 2/1998 | Selsam | 482/93 |
| 5,779,604 A | | 7/1998 | Towley et al. | 482/108 |
| 5,820,531 A | | 10/1998 | Choi | 482/93 |
| 5,879,274 A | | 3/1999 | Mattox | 482/107 |
| 5,967,952 A | | 10/1999 | Bronstein et al. | 482/111 |
| 6,010,430 A | | 1/2000 | Mankovtiz | 482/8 |
| 6,017,296 A | | 1/2000 | Tang et al. | 482/132 |
| 6,053,853 A | | 4/2000 | Hinds | 482/132 |
| 6,099,441 A | | 8/2000 | Bonnet | 482/93 |
| 6,146,318 A | | 11/2000 | Kuo | 482/132 |
| 6,190,292 B1 | | 2/2001 | Panes | 482/93 |
| 6,196,891 B1 | * | 3/2001 | Jamison | 446/250 |
| 6,234,934 B1 | * | 5/2001 | Gorczyca | 482/50 |
| 6,579,142 B1 | * | 6/2003 | Rehkemper et al. | 446/247 |

* cited by examiner

*Primary Examiner*—Nicholas D. Lucchesi
*Assistant Examiner*—Tam Nguyen
(74) *Attorney, Agent, or Firm*—Notaro & Michalos P.C.

(57) ABSTRACT

An exerciser has a hub, a flat strap having one end connected to the hub and adapted to be wound on the hub, a handle connected to an opposite end of the strap for allowing a user to hold the handle to support the hub and a pair of disk-shaped weights connected to opposite sides of the hub. The weights spin in one direction as the hub moves away from the handle and the strap unwinds from the hub, and continue in the same direction as the hub moves toward the handle and the strap winds onto the hub. The weights can each be made of a mounting dish and a plurality of hollow segments each for receiving a pourable material for adding weight to the segments. The segments are engaged to the dish to form a substantially closed disk-shaped weight and knobs are screwed to the hub and over caps for closing the hollow segment for fixing the segments to the dish. The weight can also be used for other exercise devices.

7 Claims, 9 Drawing Sheets

10
40
32
40
34
36
16
24
28
14

18
26
30
18
42
50
42
44
38
48
12
22
50
46
20
58
48

SEGMENTED WEIGHT AND EXERCISER

FIELD AND BACKGROUND OF THE INVENTION

The present invention relates generally to the field of personal exercise equipment, and in particular to a new and useful weight system having segmented weights, a tether and various attachments for a wide variety of exercises.

The marketplace is filled with personal exercise products collectively offering a wide range of approaches to the task of helping people build muscular strength and improve their physical fitness. Among the problems that people have with personal exercise products is boredom and monotony. Few products on the market address this. It is one of the objectives of the present invention to overcome the problem of boredom by offering experiences that are both physically beneficial and mentally engaging.

A search was conducted at the U.S. Patent and Trademark Office. The search encompassed United States patents categorized under the following U.S. patent classifications: Class 482; Subclasses 92, 93, 94, 98, 99, 100, 106, 107, 115, 118, 120, 121, 132 and 908.

The most pertinent patents found in the search were the following:

| U.S. Pat. No. | Inventor(s) |
|---|---|
| 590,050 | Webb |
| 610,416 | Sandow |
| 702,356 | Calvert |
| 983,372 | Johnson |
| 2,821,394 | Barbeau |
| 3,129,940 | Lauro |
| 3,752,475 | Ott |
| 3,982,755 | Sarich |
| 4,114,874 | Mattila |
| 4,114,875 | Deluty |
| 4,134,584 | Rosebusch |
| 4,482,151 | Zwilling |
| 4,515,364 | Rotella |
| 5,004,229 | Lind |
| 5,037,087 | Roth |
| 5,060,933 | Cedro |
| 5,176,599 | Beliakov |
| 5,203,753 | Rothhammer |
| 5,242,350 | Chang |
| 5,304,104 | Chi |
| 5,360,382 | Chi |
| 5,380,261 | Mora |
| 5,391,133 | Ruffa |
| 5,429,571 | Smith et al. |
| 5,486,149 | Smith et al. |
| 5,499,961 | Mattox |
| 5,512,028 | Sparks III |
| 5,618,249 | Marshall |
| 5,716,305 | Selsam |
| 5,779,604 | Towley III et al. |
| 5,820,531 | Choi |
| 5,879,274 | Mattox |
| 5,967,952 | Bronstein et al. |
| 6,010,430 | Mankovitz |
| 6,017,296 | Tang et al. |
| 6,053,853 | Hinds |
| 6,099,441 | Bonnet |
| 6,146,318 | Kuo |
| 6,190,292 | Panes. |

A search of published U.S. patent applications did not reveal any published applications classified in the same classes and subclasses as were searched for issued patents.

No patents found during the search disclose all of the same elements as the invention.

U.S. Pat. No. 4,515,364 to Rotella discloses an exercise device in the form of a rectangular body having openings for alternately receiving weights or for gripping the body. The body is flexible and can be used as a tension exerciser between two body parts. When weights are inserted in the openings, the body becomes a dumbbell for lifting. According to the Rotella '364 patent, the weight is adjusted by using different mass inserts in the openings.

U.S. Pat. No. 4,482,151 to Zwilling teaches a barbell having housings for holding annular weights of increasing diameter on the ends of the barbell shaft. The housings have a plate connected to the shaft for mounting the annular weights against. An outer cylindrical cover fits over the mounted weights and the edge of the plate. The cover is held in place using threaded screws passing radially through locking nuts to contact the shaft and make a friction connection.

U.S. Pat. No. 702,356 to Calvert illustrates a barbell having housings at each end holding a variable volume of pellet weights, such as lead shot. An end cap is fitted over a threaded shaft at each end, pressed down over the pellet weights and secured using a wing nut tightened on the threaded shaft.

Other patents disclose exercisers with weights connected to handles, such as U.S. Pat. No. 5,380,261 to Mora for an exerciser having an adjustable resistance cord winding on a handle with the other end of the cord connected to a weight.

A wrist exerciser having a handle connected to a variable mass weight is disclosed in U.S. Pat. No. 3,982,755 to Sarich. The weight is a container; the mass of the weight may be changed by adding a liquid such as water to the container. A cord connects the handle and weight. The handle has a tapered middle section, so that the handle may be rotated by hand to wind the cord about the middle section, thereby raising and lowering the weight and strengthening the wrists.

A similar wrist exerciser device is disclosed in U.S. Pat. No. 5,037,087 to Roth, in which the handle and cord are connected to a bottle weight by a threaded connection on the neck of the bottle. The Roth '087 exerciser is used in the same manner as the Sarich '755 device.

Several patents disclose cord retraction devices having one end adapted for a person to pull.

U.S. Pat. No. 5,176,599 to Beliakov discloses a resistance exerciser having a cord retraction mechanism fixed to a wall and the free end of the cord attached to a boxing glove. A person may exercise with the device by practicing boxing punches while wearing the glove, so that the cord and retraction mechanism pull against the forward motion of the punch. Alternatively, the cord can be connected to an ankle strap to provide resistance for kicks.

The search revealed patents for rolling exercisers as well. For example, U.S. Pat. No. 3,752,475 to Ott discloses a wheel mounted on a shaft having handles extending from each side of the wheel. A resistance mechanism is included between the wheel and the shaft. The Ott '475 exerciser is designed for a person to grip the handles and extend their body forward from a kneeling to nearly prone position and return, while the mechanism in the wheel provides additional resistance for exercising against.

U.S. Pat. No. 5,499,961 to Mattox teaches a rolling exerciser having a frame supporting rollers on a shaft. A person can extend his body from a kneeling to a prone position and back while gripping handles located on the shaft on either side of the rollers. The frame includes a guide for the rollers, a stop to prevent the rollers from going too far and knee pads. The ends of the roller shaft are bent backwards and slidably connected to the frame behind the knee pads.

U.S. Pat. Nos. 6,146,318 to Kuo and 6,053,853 to Hinds each disclose different types of rolling exercisers having handles mounted to means for rolling across a flat surface. The Hinds '853 patent is particularly adapted for securing a person's feet to the handles. These exercisers are otherwise clearly different from the invention.

The remaining patents disclose other exercisers and are cited for general reference.

SUMMARY OF THE INVENTION

The present invention is an exercise system which includes, in one of its embodiments, a weight having multiple segments which can be loaded with different density materials and used in pairs mounted on an axle and connected via a strap or tether to a handle or other structure.

The assembled segmented weight preferably has a disk shaped mounting body or dish supported on one end of a shaft and preferably six pie shaped segments removably secured together on the body, although as few as two and as many as twelve segments are possible. The dish has guides for aligning the segments or weight sections on the dish. The segments are held in place by a central retaining ring or hub and a locking knob. A shaft extends through, or is formed as part of the hub and a pair of the dishes. The locking knob is threaded to an end of the shaft for retaining the segments to the dish at each end of the shaft. The segments are hollow vessels which may be variably filled with different contents to affect the total mass and individual mass of the segments. Preferably, the segments are filled from the apex ends through resealable openings, such as a threaded neck that can be closed by a threaded cap. The locking knob engages over the cap of each segment to lock the segment to the dish. The segments or sections can be filled with liquids such as water or granular solids, such as sand, beans, grain or other granular material. A second like weight is removably secured to the other end of the shaft.

An exerciser according to one embodiment of the invention uses a pair of these weights on the shaft, connected to a handle using a flexible flat strap, tether or cord. The handle has a yoke with one end of the strap secured to it. Extensions may be secured to the handle to make it longer and extend to the sides of the yoke. Preferably, the strap is secured to the yoke using a retaining pin inserted through a loop at the end of the strap positioned inside a slotted chamber formed in the yoke, so that the loop is prevented from leaving the chamber, while the strap extends through the slot.

The other end of the strap is connected to the shaft with the weights in a similar manner. The shaft may include an axially mounted guide for the strap, which can spin freely on the shaft. The lower end of the strap may be fixed at one circumferential position on the hub and wound on the hub. The handle, strap, hub and shaft are connected so that in a standing position, the exerciser works like a yo-yo. The weights drop as the strap unwinds from around the hub shaft to a low point just above the ground, and the user then controls the weights to return them by causing the strap to rewind on the hub in the opposite direction. In one embodiment the shaft and hub are one piece of strong plastic or metal. The segmented weights may also be replaced by one piece weights or single-chamber weight for receiving water or granular material.

In other embodiments used with floor-supported exercisers, the strap or tether is connected to a rewind tension mechanism and the weights can roll on the floor. As the weights are extended away from the rewind mechanism, it causes the strap to tension, and the rewind mechanism draws the strap back on the return stroke. The weights are preferably of the segments type disclosed above, but may be solid or have a single chamber to be filled with a weighted, pourable mass such as water or granular solid.

In a further embodiment of the invention the weight are placed on opposite sides of a central elongated handle to create a dumbbell or, with a longer cental handle, a barbell.

The present invention can be used in various postures and for various physical exercises.

When used like a yo-yo, the invention provides a valuable exercise as the user controls the movement of the spinning weight while holding the handle yoke in one hand or a pair of handle extensions in two hands. The user can find a rhythm for the up and down motion which he or she finds most effective to exercise the arms. Successful use of the invention in this yo-yo mode of use also requires the user to adjust to the device's changing patterns of spin and accommodate to its cyclical shifting of weight for a more interesting exercise session. The harmonious mental engagement that results from successful operation of the invention keeps boredom at bay. The beneficial physical effects of operating the invention with weights that can range from two to forty pounds or more, frequently take place in a state of "flow" wherein the user and the device are in harmonious physical/mental synchrony.

The invention can also be a social product. Although fitness activities, even in a public gym, are usually individual, isolating experiences that separate users from friends, family and colleagues, the present spinning weight invention is designed so that it can be passed around while in action.

Passing the exerciser of the invention from one person to another while keeping the weight spinning, rising and falling can be an enjoyable challenge for groups of people. This will have particular interest for settings like senior citizens centers where sociability is often a key to a successful exercise.

In another embodiment, with the exchange of key parts, the invention can be used to exercise the legs and arms while the user is in a seated position, on the floor, on a stool, chair or sofa. The exercise activity can take place in relaxed, social, congregate. In yet another version, with an additional exchange and adjustment of parts, users can gather in small groups on bare or carpeted floors and engage in exercising the abdomen, back and upper arms.

Accordingly it is an object of the present invention to provide an exerciser comprising: a hub; a flat strap having one end connected to the hub and adapted to be wound on the hub; a handle connected to an opposite end of the strap for allowing a user to hold the handle to support the hub; and a pair of disk-shaped weights connected to opposite sides of the hub for spinning in one direction as the hub moves away from the handle and the strap unwinds from the hub, and in the one direction as the hub moves toward the handle and the strap winds onto the hub, the weights spinning in an opposite direction as the hub thereafter moves away from the handle and the strap again unwinds from the hub.

Another object of the invention is to provide a weight for use with this exerciser or for use with other weighted exercisers which comprises: a mounting dish; a plurality of hollow segments each for receiving a pourable material for adding weight to the segments, the segments being engaged to the dish to form a substantially closed disk-shaped weigh; and means for fixing the segments to the dish.

Still further objects of the invention provides exercisers which combined the segmented, disk-shaped weights in pairs connected to a handle to form a bar bell or dumb bell, or with handles, a strap, a biased winding mechanism and a knee pad to form a floor exerciser, or with a biased winding mechanism, handles, a strap and peddles to form a different type of floor or seat exerciser.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
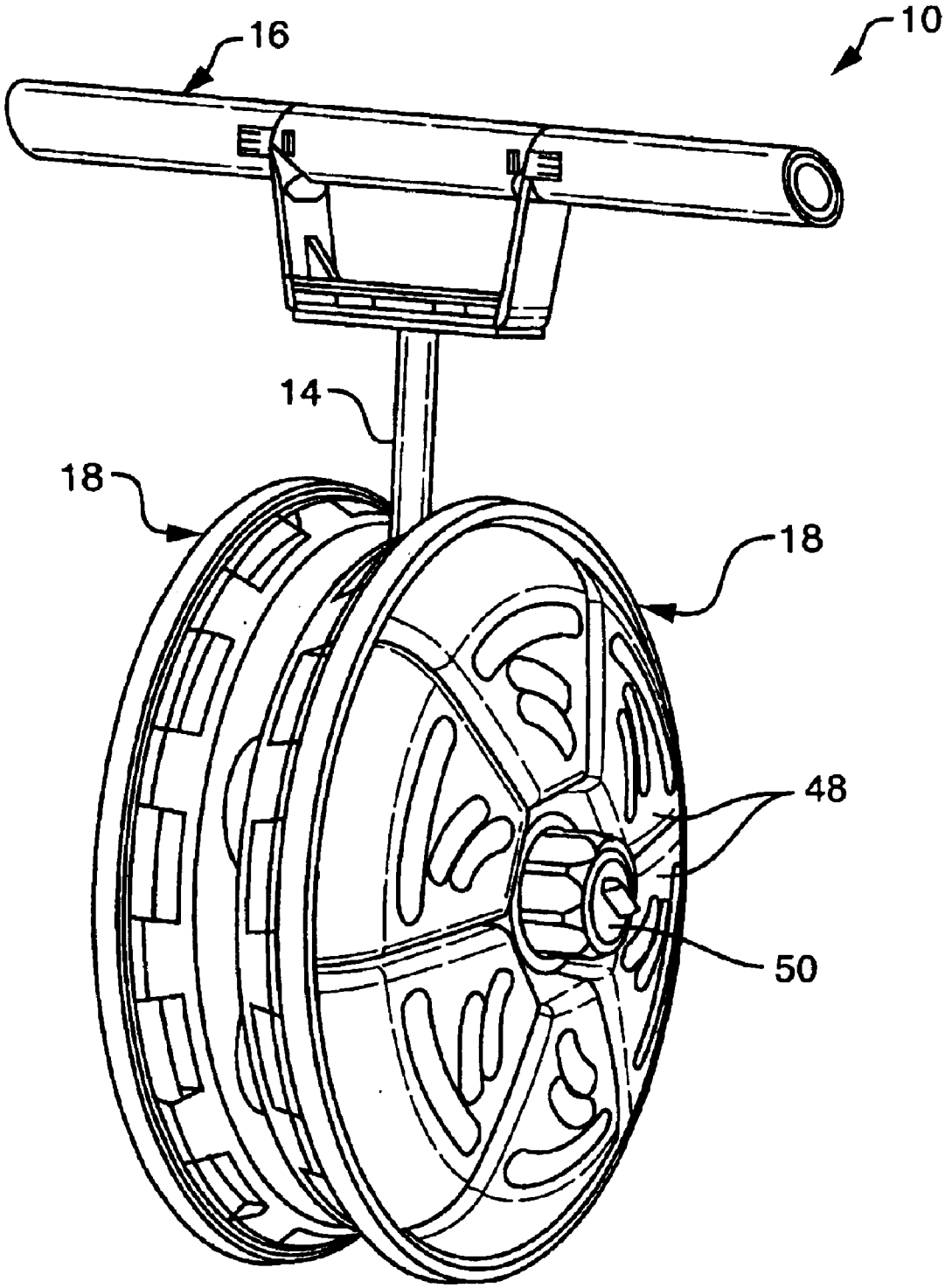
FIG. 1 is a perspective view of the exerciser of the invention in the form of a yo-yo like device.

Referring now to the drawings, in which like reference numerals are used to refer to the same or similar elements, FIGS. 1, 2, 2A and 2B illustrate the exerciser of the present invention, generally designated 10, which comprises a central hub 12, a flat strap 14 made for example of strong synthetic material such as nylon, having a lower end connected to hub 12, and a handle generally designated 16 connected to the upper end of strap 14. A pair of disk-shaped weights generally designated 18 are connected at opposite sides of hub 12 for spinning with the hub in one direction as the hub moves away from the handle so that the strap 14 unwinds from the hub and, due to the spinning inertia of the weights 18,18, continues to spin in the same direction to now wind strap 14 on the hub as the weights move toward the handle. At the top or apex of movement for the weights, their direction of rotation is reversed causing strap 14 to now begin to unwind from hub 12 as the pair of weights moves away from the handle. At the bottom of the stroke the weights continue to spin in the same direction causing strap 14 to wind on hub 12 and again move the weights toward the handle. This yo-yo action can be repeated so that the user is both enjoying a beneficial exercise of the arms and upper body and at the same time the user's interest is maintained because of the dynamics of the spinning weights and their movement up and down. Bending knees and rising to the balls of one's feet while the disks/hub are in motion involves leg, calf and ankle muscles for further benefits.

Figure 2:
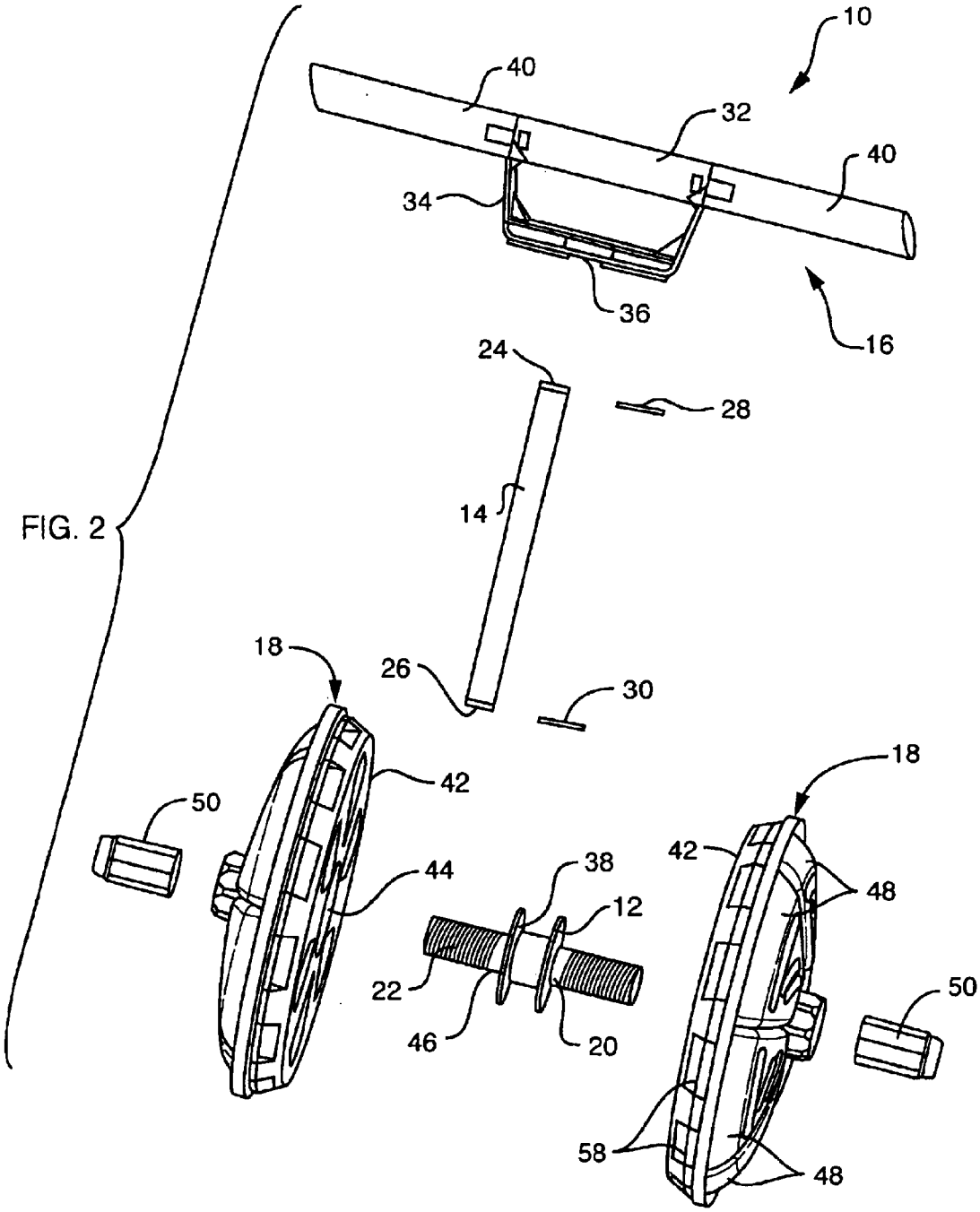
FIG. 2 is an exploded view of the execiser of FIG. 1.
Figure 2A:
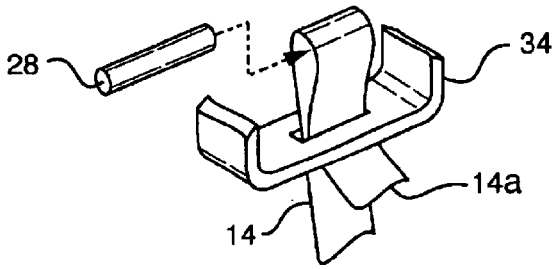
FIG. 2A is an enlarged view of an alternate attachment for the strap of the invention.

As best shown in FIG. 2, a shaft 20 extends through or is formed as one piece with hub 12 and has a pair of opposite threaded ends 22. The upper and lower ends of strap 14 include loops or eyes 24,26 which are shaped to receive a pair of plastic studs or stops in the form of small cylinders 28,30. Handle 16 includes a central yoke 32 with a handle portion at the top and which can be held by one hand and a U-shaped portion or yoke base at the bottom. The cross leg of the U-shaped portion 34 includes a slotted recess 36 which is shaped to receive the upper eye or loop 24 of strap 14. Stud 28 is inserted into the loop to retain the upper end of strap 14 in the recess 36 and thus to the handle 16. FIG. 2A shows an alternate means of attaching strap 14. A free end 14*a* of the strap is looked into a slot in the yoke base 34 and cylinder or pin 28 is placed into the loop to lock the loop to base 34 when the strap 14 is pulled taught. This makes the length of strap 14 adjustable. A similar attachment can be used at the hub 12.

In likewise fashion, a slotted recess 38 is provided in hub 12 for receiving the lower end of strap 14 and its loop 26. Stud 30 is inserted into the loop 26 when it is inside the slotted recess in hub 12 to retain the lower end of the strap to the hub. Recess 38 extends to the inside of hub 12 but outside shaft 20.

Figure 2B:
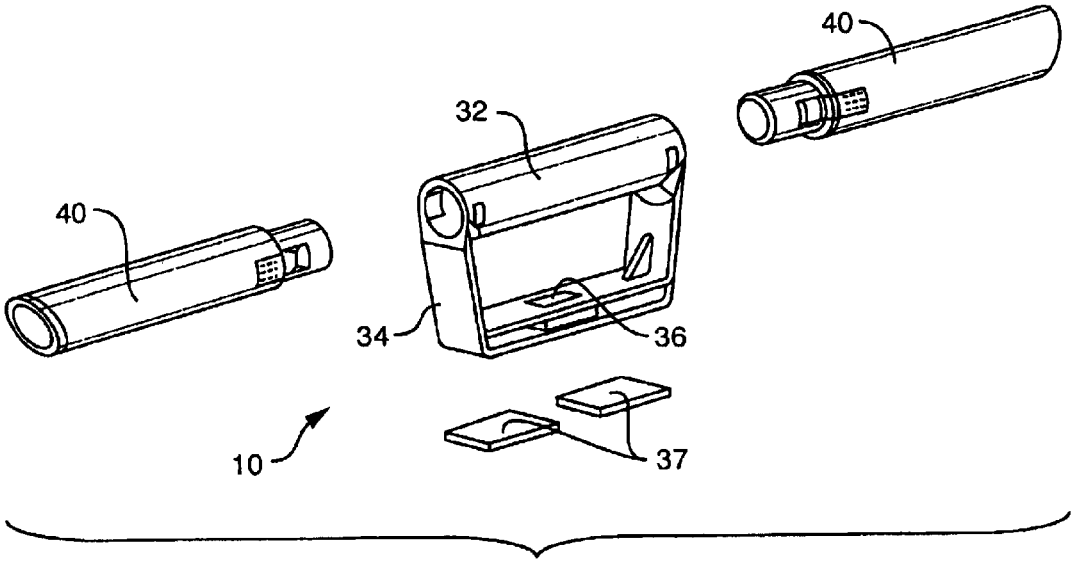
FIG. 2B is an exploded view of the handle assembly of the exerciser of FIG. 2.

Handle 16 also includes a pair handle extensions 40 which can be snap fit into hollow ends of the handle portion of the yoke 32 so that the exerciser can be held by two hands. FIG. 2B shows details and also cushion pads 37 adhered to the bottom of yoke 32 so that the outer circumference of weights 18 may strike the bottom of the yoke without damage.

Each of the weights 18 includes a dish 42 having a central keyed hole 44 (FIG. 3) for engaging over shaft 20 and onto keys 46 on the shaft and near the hub 12 so that the dish 42 is non-rotatably fixed to shaft 20. Shaft 20 can extend through or be formed as one part with hub 12, for example of metal or plastic, so that hub 12 is rotatably fixed with respect to shaft 20 in one embodiment of the invention. In another embodiment where shaft 20 is simply slipped into hub 12 the invention can be made to "sleep" like a yo-yo. More on this feature later in this disclosure.

Each weight 18 also includes a plurality of segments 48 which are fixed to the dish 42 and held in place by a pair of knobs 50 which are treaded to the opposite treaded ends 22 of shaft 20.

Figure 3A:
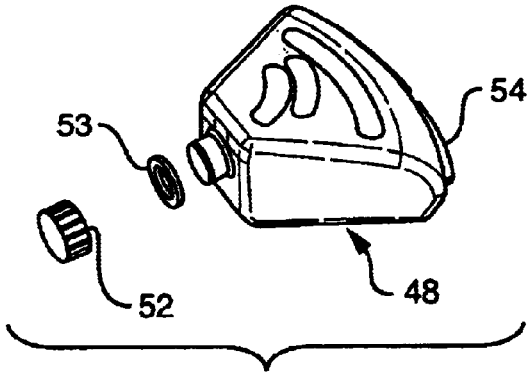
FIG. 3A is an exploded view of one of the segments.
Figure 3:
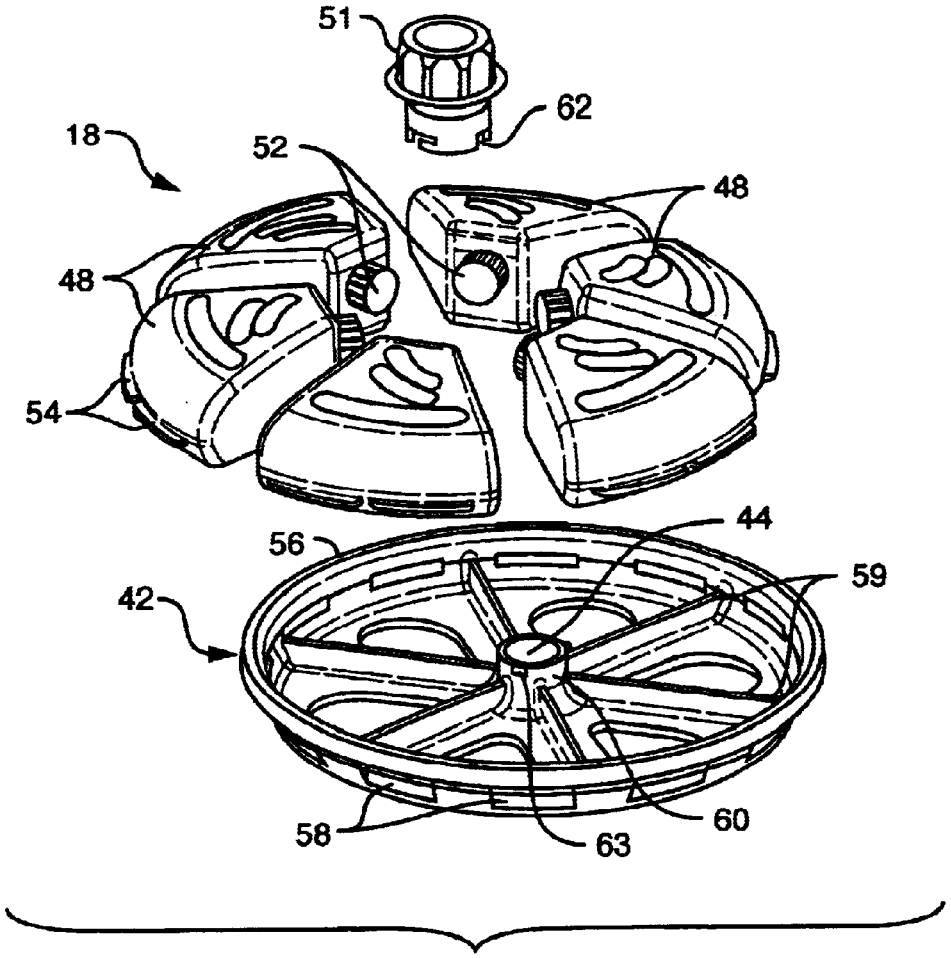
FIG. 3 is an exploded view of the segmented weight according to another feature of the invention.

As best shown in FIGS. 3 and 3A, each of the segments 48 comprises a plastic wedge-shaped container having a threaded neck facing radially inwardly and covered by a closure or cap 52 and washer 53. The radial outer end of each segment 48 is larger in the circumferential direction around the weight 18 and includes a pair of radially outwardly extending tabs 54.

The disk-shaped dish 42 includes a rim 56 which extends axially to encompass the outer perimeter of the segments 48. Rim 56 includes spaced slots 58 best shown in FIG. 2, each for receiving one of the tabs 54 to retain the outer radial ends of the segments 48 in the dish 42. Radial partition walls 59 extend from rim 56 to a central sleeve 60 of dish 42 for receiving shaft 20. This helps secure each of the segments 48 in its appropriate section of the dish 42. The tabs 54 and slots 58 can exchange position or the rim can have a slot and tab and each segment can have a mating slot and tab.

Threaded knob 50 may include a radially extending flange or the device may include a separate retainer cap 51 which, when the knob is screwed to the threaded end 22 of shaft 20, engages over the caps 52 to retain the radial inner ends of the segments to the dish 42. Cap 51 is connected to dish 42 by bayonette slots 62 that engage projections 63 on sleeve 60.

This form of the invention, like a large heavy yo-yo, can be held by two hands using the handle extensions 40 or by one hand using yoke 32 (with the extensions 40 removed). Starting with the strap 14 fully wound on the hub 12 and the weights 18 close to the handle 16, the user, firmly holding the handle or handles, lets the weights fall and begin their spinning in one direction to unwind strap 14 from hub 12. The spinning continues in the same direction at the bottom of the stroke at which time the weights, due to their spinning inertia, rise and wind the strap 14 on the hub.

The exercise can be conducted while standing or seated and depends on gravity to spin the weights as well as the dynamics of the users raising and lowering the handle in time with the spinning action of the weights. The exercise can also be performed while kneeling.

Although the segmented weights 18 are shown, solid weights in the form of a pair of disks can be used instead or a single large hollow weight which can be filled with pourable materials such as water or granular material.

In the embodiments shown in FIGS. 1, 2 and 3, each of the segments 48, with its cap 52 removed, can be filled with water or granular material to a desired extent to add a desired amount of weight to the device. Just as with the classic yo-yo, the present invention can be modified to "sleep". With shaft 22 and dishes 42 held only by friction to hub 12 and made as a separate part, it is possible for the weights to spin without causing the strap 14 to rewind on the hub when the weights are at the bottom of their motion. With a gentle lifting of the handles the frictional engagement between hub 12 and shaft 20 can momentarily allow strap 14 to begin winding on the hub and thus allowing the weights 18 to rise toward the handle 16. This sleeping action can also be adjusted by tightening or loosening knobs 50 so that dishes 42 engage more tightly or less tightly against the opposite flanges of hub 12 to adjust the tendency of the device to "sleep".

While a preferred embodiment utilizes six segments 48, as little as two segments and as many as twelve segments can be used in accordance with the present invention with suitably modified disk-shaped dishes 42.

Figure 4:
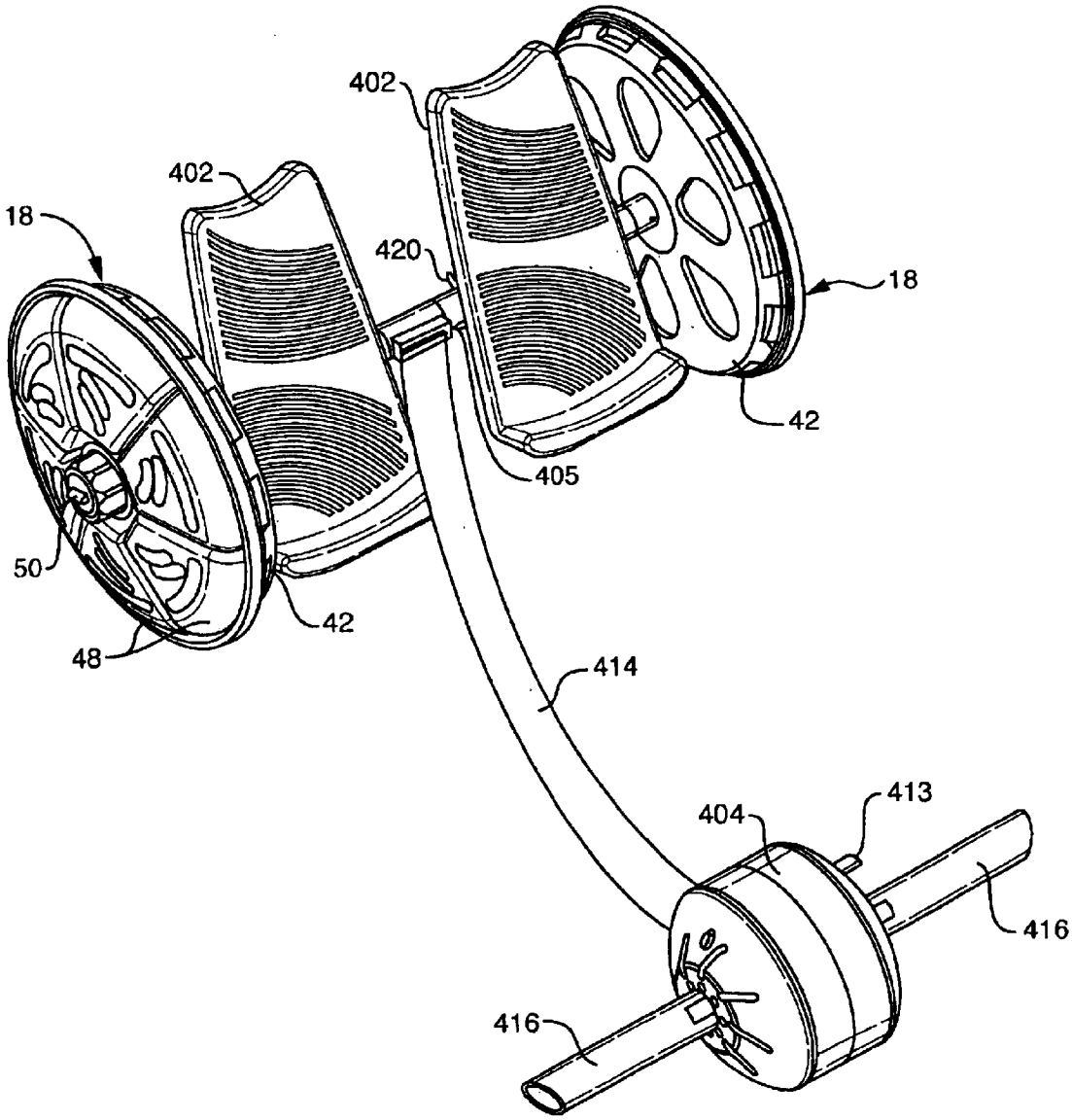
FIG. 4 is a perspective and partly exploded view of another embodiment of the invention usable for floor exercises.
Figure 4A:
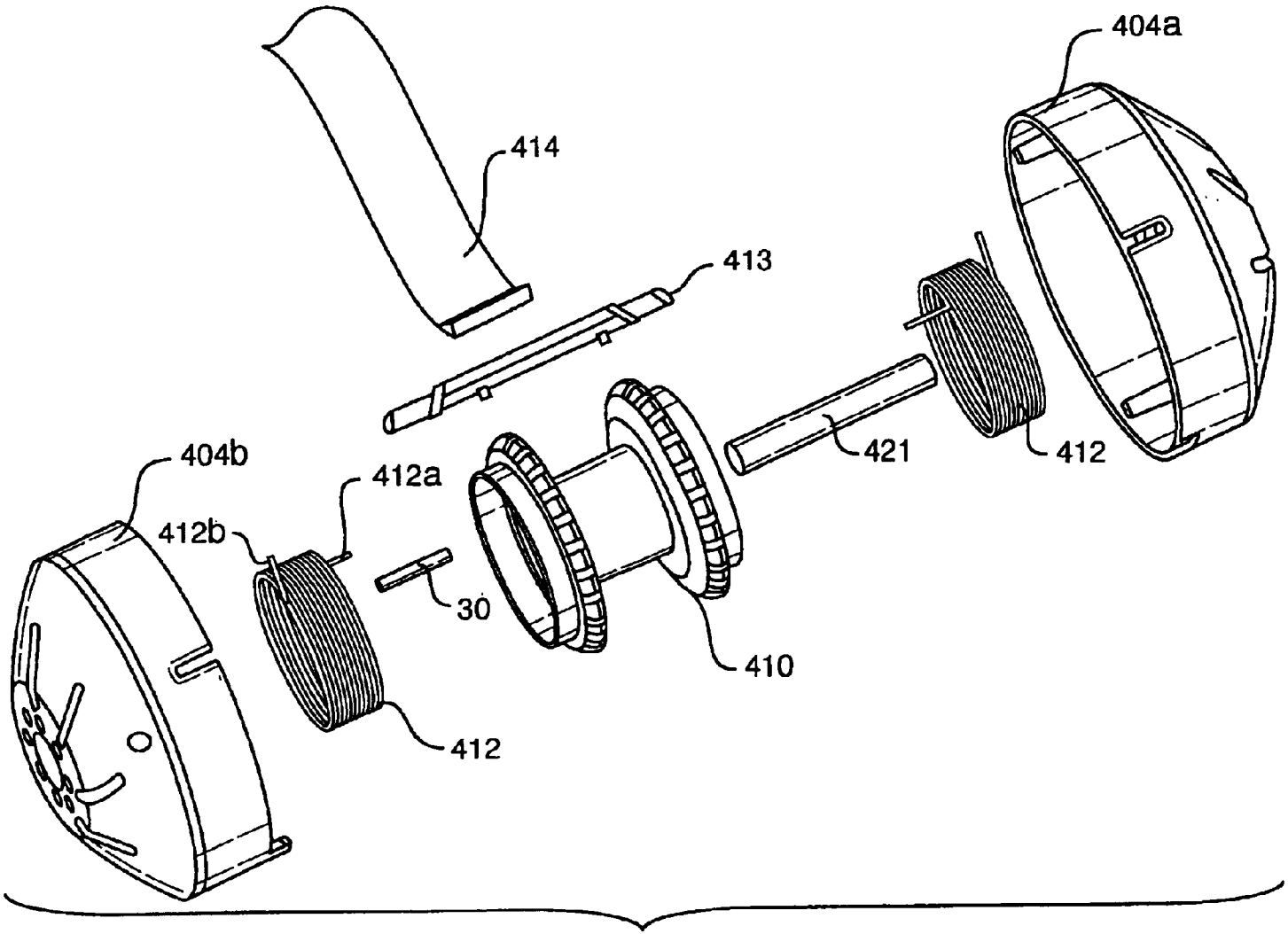
FIG. 4A is an exploded view of the retraction housing of the device of FIG. 4.

FIGS. 4 and 4A show another embodiment of the invention which utilizes segmented weights 18 mounted to opposite ends of a shaft 420 using knobs 50. Weights 18 include the weighted segments 48 mounted to the dishes 42 as with the embodiment of FIG. 1.

A pair of foot pedals 402 are fixed to shaft 420 and a longer nylon strap 414 has one end fixed to shaft 42 and another end wound on a spring loaded spindle 410 in a housing 404. A pair of handles 416 extend from opposite sides of housing 404. Spindle 410 is wound on shaft 421 under biasing force of a helical springs 412 or other tensioning mechanism. FIG. 4 also shows a mechanism for attaching each pedal 402 to the shaft 420 via a pair of snap fittings 405 engaged on opposite sides of the shaft.

With the user seated on the floor and his or her feet engaged in the pedals 402, handles 416 can be held and the feet extended to extend strap 414 against the spring loaded spindle 421 in housing 404. The weights 18 roll on the floor. As shown in FIG. 4A, housing 404 is made of snap-together halves 404*a* and 404*b* which enclose over the spring mechanism. A stop pin 413 slides to a locked position in the housing to stop rotation of spindle 410 relative to housing 404. This allows the strap 414 to be loose and slack as shown in FIG. 4 for safety reasons.

Figure 5:
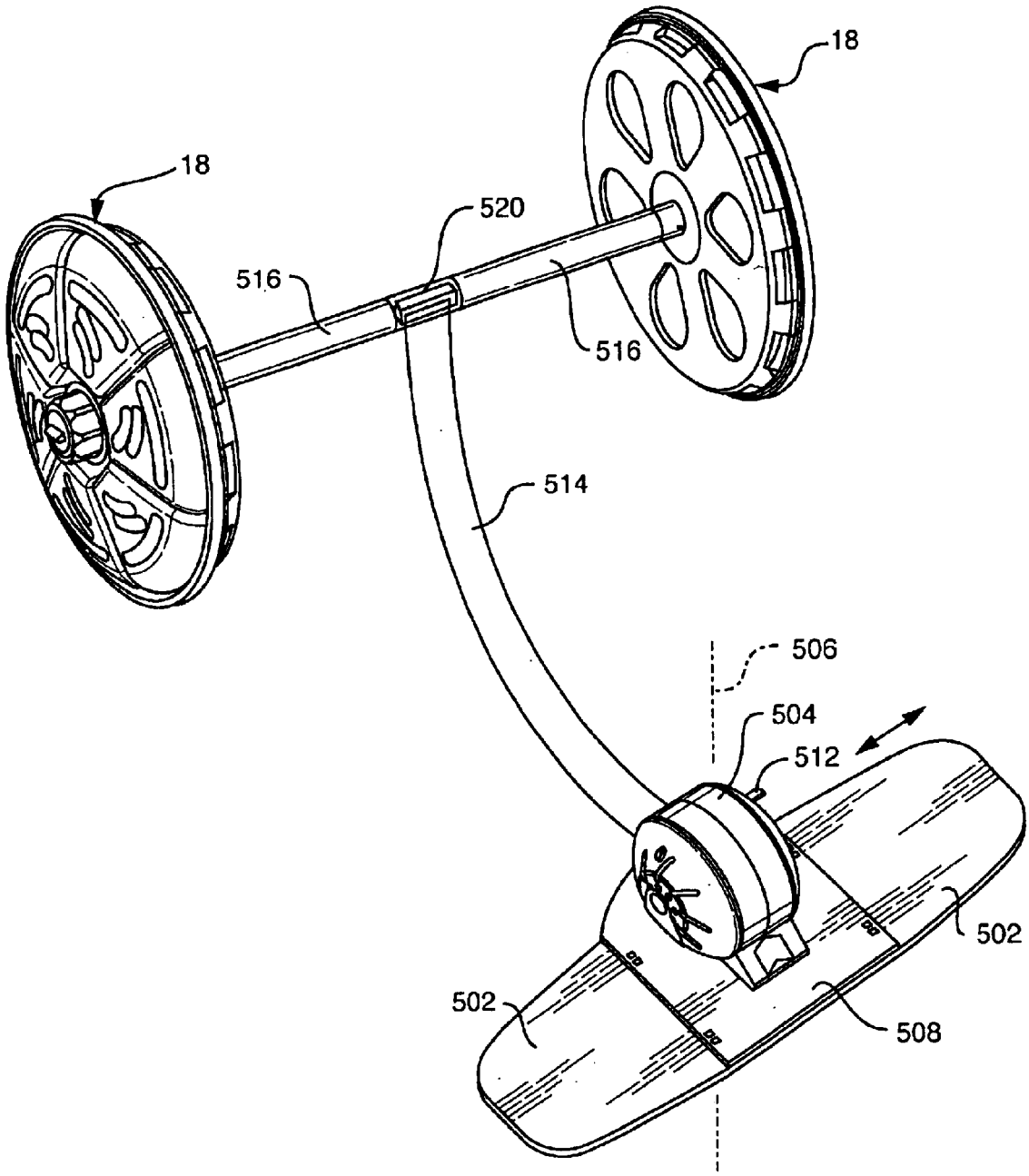
FIG. 5 is a perspective view of a still further embodiment of the invention which is also usable for floor exercises.
Figure 5A:
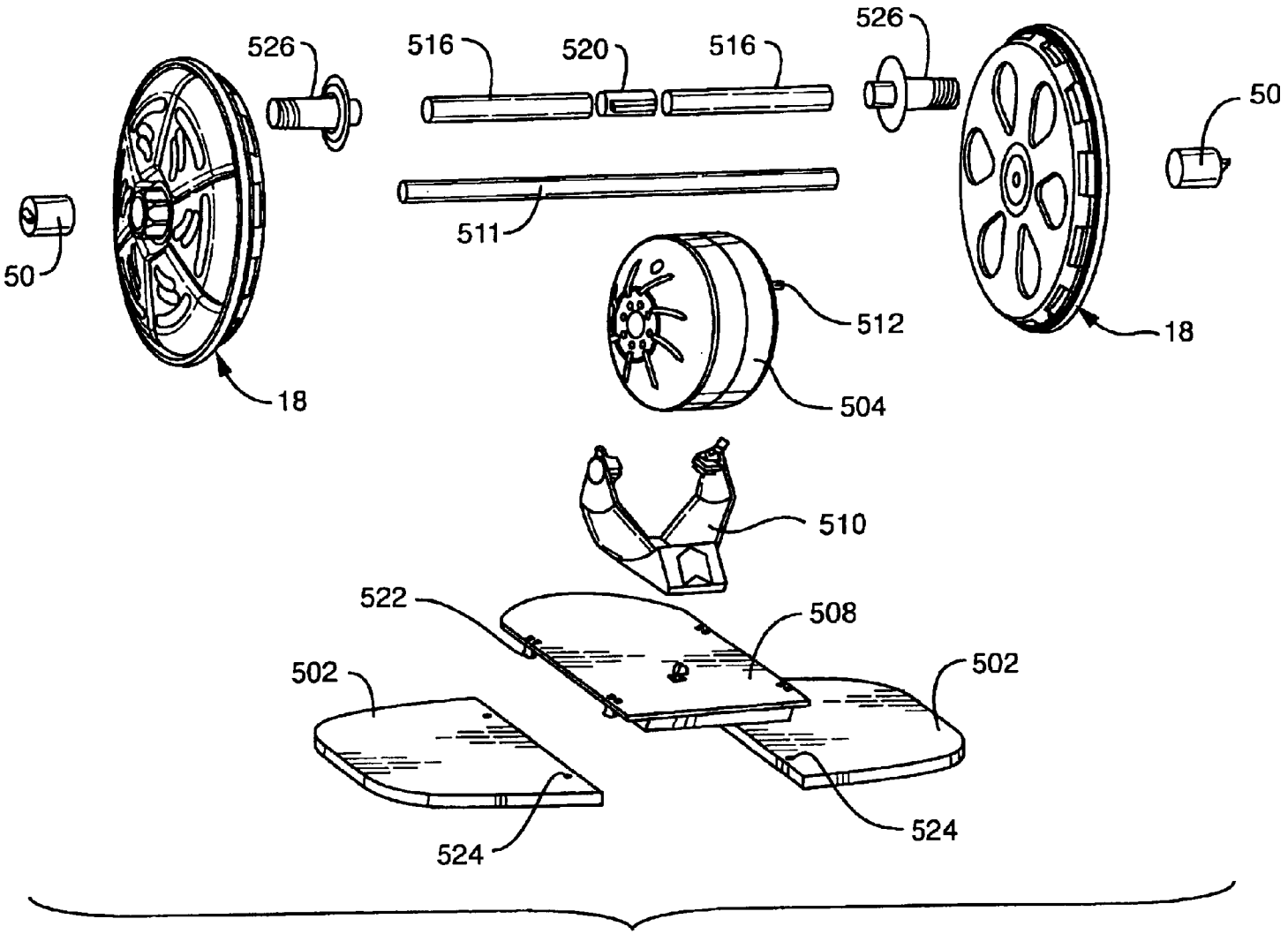
FIG. 5A is an exploded view of the FIG. 5 device.

The embodiment of FIG. 5 and FIG. 5A include the same type of biased wind up mechanism in a housing 504 which winds up and extends a strap 514. The housing 504 is fixed in a pivoting fork 510, pivotally mounted on a holder 508 which is attached to a pair of knee pads 502 by snap tabs 522 that snap into holes 524 in pads 502. Knee pads 502 and holder 508 extend in a plane below housing 504 and fork 510 which is mounted for pivoting about a vertical axis 506. The opposite end of strap 514 is connected to a shaft sleeve 520 on a shaft 511 having grip handles 516 and segmented weights 18, on either end held by hubs 526. The user with his or her knees on pads 502 can use their body and arms to extend and retract weights 18 on sleeve 520 toward and away from the users knees and in various directions due to the pivotal mounting of housing 504 on pad 502 about vertical axis 506. Flexible sided fork 510 can be spread to release housing 504 from holder 508 so handles can be attached to the housing and the housing used in the embodiment of FIG. 4. A brake pin 512 can be pushed in the direction of the double arrow to fix the strap 514 in place for certain exercises. Sleeve 520, handles 516 and hubs 526 are mounted on shaft 511 and hubs 50 screw to the ends of hubs 526 to hold the assembly to the weights 18.

Figure 6:
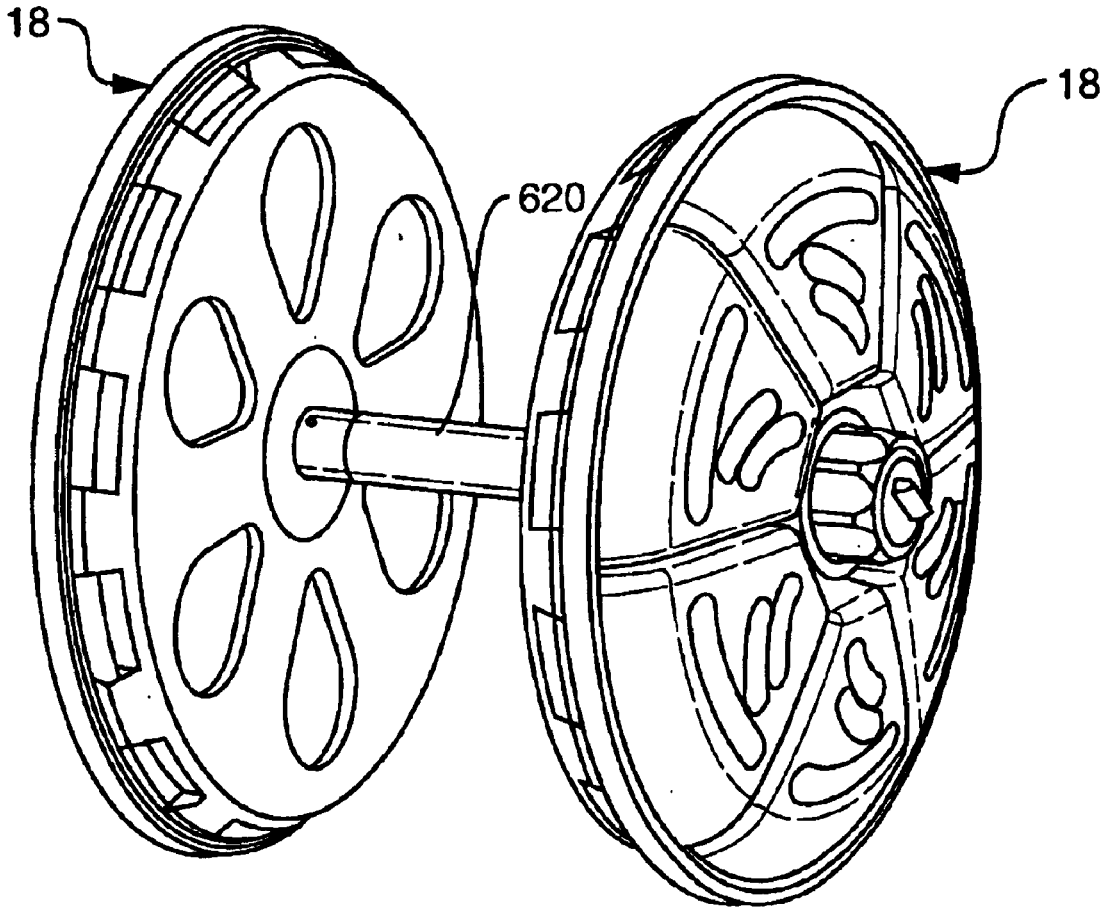
FIG. 6 is a perspective view of another embodiment of the invention usable as a bar bell or dumb bell.

FIG. 6 shows another embodiment of the invention where a cross handle 620 which also serves as a shaft for a pair of segmented weights 18, can be used in one hand to form a dumbbell or handle 620 can be extended so that it can be held by two hands to form a barbell. The same hubs 526 as in FIG. 5A can be used over a shaft to hold weights 18 on handle 620.

Referring once more to FIG. 4A, the winding means is shown out of housing 404 as being a spindle 410 rotatable on shaft 421 for winding one end for the strap 414, and coiled springs 412 having one end 412*a* fixed to the spindle on the shaft, and the other end 412*b* fixed in the housing half to resist unwinding of strap 414 from the shaft and to cause the strap to rewind on the spindle and into the housing.

The embodiments of FIGS. 4 and 5 differ in that in the embodiment of FIG. 4 first securing means for securing the housing with respect to the opposite end of the strap 414 is in the form of the pair of handles 416 extending from opposite sides of the housing 404 while the first securing means in the embodiment of FIG. 5 is in the form of the knee pad 502.

The second securing means for securing the opposite end of the strap in the embodiment of FIG. 4 is in the form of the pair of pedals 402 fixed to the shaft 420 while in the embodiment of FIG. 5 the second securing means is in the form of handles 516 engaged around shaft 520. In each of the embodiments the legs or feet of the user are used to secure one end of the device while the hands are used to wind and unwind the strap to produce useful exercise.

While specific embodiments of the invention have been shown and described in detail to illustrate the application of the principles of the invention, it will be understood that the invention may be embodied otherwise without departing from such principles.

What is claimed is:

1. An exerciser comprising:

a hub;

a flat strap having one end connected to the hub and adapted to be wound on the hub;

a handle connected to an opposite end of the strap for allowing a user to hold the handle to support the hub; and a pair of disk-shaped weights connected to opposite sides of the hub for spinning in one direction as the hub moves away from the handle and the strap unwinds from the hub, and in the one direction as the hub moves toward the handle and the strap winds onto the hub each disk-shaped weight comprising:

a mounting dish;

a plurality of hollow segments each for receiving a pourable material for adding weight to the segments, the segments being engaged to the dish to form a substantially closed disk-shaped weight;

a closure connect to each segment for closing each segment; and means for fixing the segments to the dish.

2. An exerciser according to claim 1 wherein the mounting dish includes a raised rim, each hollow segment including an outer edge, said means for fixing the segments including a slot in at least one of the rim and outer edge and a tab in the other of the rim and outer edge for engaging in said slot.

3. An exerciser according to claim 2 wherein each closure comprises a cap connected to a respective segment and on a radial inner end of each segment, said means for fixing the segments including a shaft extending on opposite sides of the hub and a knob connected to the shaft and engaged against the caps for retaining radial inner ends of the segments to the dish.

4. An exerciser according to claim 1 wherein each closure comprises a cap connected to a respective segment and on a radial inner end of each segment, said means for fixing the segments including a shaft extending on opposite sides of the hub and a knob connected to the shaft and engaged against the caps for retaining radial inner ends of the segments to the dish.

5. An exerciser according to claim 1 wherein said dish includes a plurality of radially extending partition wails and a circumferentially extending rim, each of said segments being engaged between adjacent walls and within said rim.

6. An exerciser according to claim 1 wherein said handle comprises a yoke having a U-shaped portion and a handle portion, said strap being connected to said U-shaped portion.

7. An exerciser according to claim 6 including a pair of handle extensions each connected to and extending outwardly from said handle portion.

* * * * *